US012359527B2

(12) United States Patent
Saraya

(10) Patent No.: US 12,359,527 B2
(45) Date of Patent: Jul. 15, 2025

(54) METHODS AND SYSTEMS FOR A DISSOLVABLE PLUG

(71) Applicant: Vertice Oil Tools, Inc., Stafford, TX (US)

(72) Inventor: Mohamed Saraya, Sugar Land, TX (US)

(73) Assignee: Vertice Oil Tools Inc., Missouri City, TX (US)

( * ) Notice: Subject to any disclaimer, the term of this patent is extended or adjusted under 35 U.S.C. 154(b) by 0 days.

(21) Appl. No.: 18/648,660

(22) Filed: Apr. 29, 2024

(65) Prior Publication Data

US 2024/0279996 A1 Aug. 22, 2024

Related U.S. Application Data

(63) Continuation of application No. PCT/US2022/053658, filed on Dec. 21, 2022.

(60) Provisional application No. 63/298,669, filed on Jan. 12, 2022.

(51) Int. Cl.
*E21B 33/128* (2006.01)
*E21B 33/12* (2006.01)

(52) U.S. Cl.
CPC ..... *E21B 33/1208* (2013.01); *E21B 2200/08* (2020.05)

(58) Field of Classification Search
CPC ..... E21B 33/134; E21B 33/128; E21B 23/06; E21B 23/14
See application file for complete search history.

(56) References Cited

U.S. PATENT DOCUMENTS

| | | | | |
|---|---|---|---|---|
| 1,035,161 | A * | 8/1912 | Cortinas | E21B 27/00 166/99 |
| 1,704,152 | A * | 3/1929 | Stephens | E21B 33/08 277/330 |
| 2,230,447 | A * | 2/1941 | Bassinger | E21B 33/134 166/134 |
| 5,819,846 | A * | 10/1998 | Bolt, Jr. | E21B 33/134 166/123 |
| 8,376,044 | B2 * | 2/2013 | Ostevik | E21B 23/06 166/179 |
| 9,309,733 | B2 * | 4/2016 | Xu | E21B 23/01 |
| 11,078,744 | B2 * | 8/2021 | Kennedy | E21B 33/1208 |
| 11,203,913 | B2 * | 12/2021 | Martin | E21B 33/129 |
| 11,261,683 | B2 * | 3/2022 | Kellner | E21B 23/01 |
| 11,459,850 | B2 * | 10/2022 | Power | E21B 33/134 |
| 12,018,545 | B2 * | 6/2024 | Zhong | E21B 33/1291 |

* cited by examiner

*Primary Examiner* — Kenneth L Thompson
(74) *Attorney, Agent, or Firm* — Pierson IP, PLLC

(57) ABSTRACT

A sliding object positioned on a breakable stem, wherein slips are configured to be engaged, followed by the breakable stem breaking, performing a fracturing procedure above the object, and sliding the object on the stem based on flow back through the frac plug mandrel. The object may be part of the frac plug, and run in the hole along with the frac plug in a single run. This allows the well to be pressure tested, perforated, and re-establish communication without positioning additional tools, sleeves, balls, etc. downhole.

16 Claims, 12 Drawing Sheets

METHODS AND SYSTEMS FOR A DISSOLVABLE PLUG

BACKGROUND INFORMATION

Field of the Disclosure

Examples of the present disclosure relate to a dissolvable frac plug. More specifically, embodiments are directed towards a sliding object positioned on a breakable stem, wherein slips of the dissolvable frac plug are configured to be engaged, followed by the breakable stem breaking, performing a fracturing procedure above the object, and sliding the object on the stem based on flow back through the frac plug mandrel.

Background

Conventionally, after cementing a well and to achieve frac/zonal isolation for a frac operation, a frac plug, and perforation guns on a wireline or other conveying methods (including fluid pumping) are pushed downhole to a desired depth. Then, the frac plug is set and the perforation guns are fired above to create a conduit to frac fluid. This enables the fracing fluid to be pumped. These conventional frac plugs are held in place via slips and seals via packing elements or O-rings, which may require complex operations and/or additional tools to set.

After an operation involving the downhole plug is complete, the plug must be removed from the wellbore or otherwise disposed of through milling or drilling. However, these operations can also be complex, time-consuming, and expensive. Further, running a bottom-set frac plug may not allow running a ball on a seat. For example, once the frac plug is set, a ball could be dropped to form a seal. This requires dropping balls from the surface, with associated fluid pumping, in which consumers consume frac fluid, time, and costs.

Accordingly, needs exist for systems and methods for a single run frac plug that utilizes a sliding object positioned on a stem with a weak point, wherein the weak point may be broken after setting the slips of the frac plug and portions of the stem above the weak point may be removed from the downhole environment before fracing above the object. Further, needs exist to make this frac plug and the stem components dissolvable so there will be no need to cleaning or milling trips after fracing.

SUMMARY

Embodiments disclosed herein describe systems and methods for a frac plug. The frac plug may include a body, stem holder, a stem, an object, and a setting sleeve. Embodiments allow the object to be incorporated as part of the frac plug, and run in the hole along with the frac plug in a single run. This allows the well to be pressure tested, perforated, and re-establish communication without positioning additional tools, sleeves, balls, etc. downhole.

The body may be a mandrel with expandable elements that form a seal across an annulus, such as slips positioned on an outer diameter of the body. The expandable elements may be standalone elements positioned on the outer diameter of the body or may be integrated with the body. In embodiments, the slips may be configured to be set based on pressure or force being applied against the body via the setting sleeves. For example, the slips may be expanded across an annulus to be positioned adjacent to the casing based on a downward force applied to the body by the setting sleeves. However, the slips may be set based on any known method. Additionally, the body may include a hollow passageway that allows fluid to flow through the body if the body is not sealed by the object.

The stem holder may be coupled to a lower surface of the body or any other part of the frac plug, and be a device that is configured to secure and hold the stem. The stem holder may be configured to selectively hold the stem in place. In embodiments, the stem holder may hold the stem in place until a shearing device coupling the stem holder and the stem together is broken. After the stem and stem holder are decoupled from each other and flow back is applied against the object and the stem, the stem, and object may be removed from an inner diameter of the body.

The stem may be a rod, shaft, etc. that extends through the body, such that an upper surface of the stem is positioned within or above the upper surface of the body. In embodiments, the stem may be aligned with a central axis of the body. A lower end of the stem may be selectively coupled to the stem holder, within or below the body. The stem may include a weak point and a stopper. The weak point is configured to break to allow an upper portion of the stem to be disconnected, permanently decoupled, etc. from a lower portion of the stem. After the upper portion of the stem is disconnected from the lower portion of the stem, the upper portion of the stem may be retrieved from the well. The weak point may be broken based on forces applied by the setting sleeve or any other device against the stem. The stopper may be positioned between the weak point and the object. The weak point is configured to limit the movement of the object in the first direction, wherein the first direction may be towards the surface of the well.

The object may be a free-floating ball along the stem, and the object may be configured to selectively form a seal within the body, wherein the object is run in the hole from a surface attached to the stem. In embodiments, the object may be any shape or size, such as a disc, that is aligned with a central axis of the downhole tool. In embodiments, the stem may be configured to be inserted through a port within the object, wherein the object can slide along the stem. In the first mode, the object may seal the hollow chamber through the body. In a second mode, the object may slide along the stem to no longer seal the hollow chamber. In embodiments, the object may operate as a check valve and may move from the first mode to the second mode based on flow back through the body. Additionally, the object may be configured to dissolve. After the object has dissolved, the object may no longer be able to form a seal within the body. In other embodiments, the stem and the object may be made of one piece, where the stem is the sliding piece against the stem holder The setting sleeve may be a device, such as a running tool, that is configured to set the expandable elements based on applying a force against the body in a second direction. The setting sleeve may also be configured to break the weak point along the stem based on applying force against the stem. After the weak point is broken, the upper portion of the stem and the setting sleeve may be removed from the well together. In other embodiments, the upper portion of the stem may be eliminated and disconnect/breakage can take place between the setting sleeve and the stem directly. The setting sleeve may be part of a running tool that is conveyed via a slick line, wireline, coiled tubing, or jointed pipes.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions, or rearrangements may be made within the scope of the invention, and the invention includes all such substitutions, modifications, additions, or rearrangements.

BRIEF DESCRIPTION OF THE DRAWINGS

Non-limiting and non-exhaustive embodiments of the present invention are described concerning the following figures, wherein reference numerals refer to like parts throughout the various views unless otherwise specified.

Figure 1A:
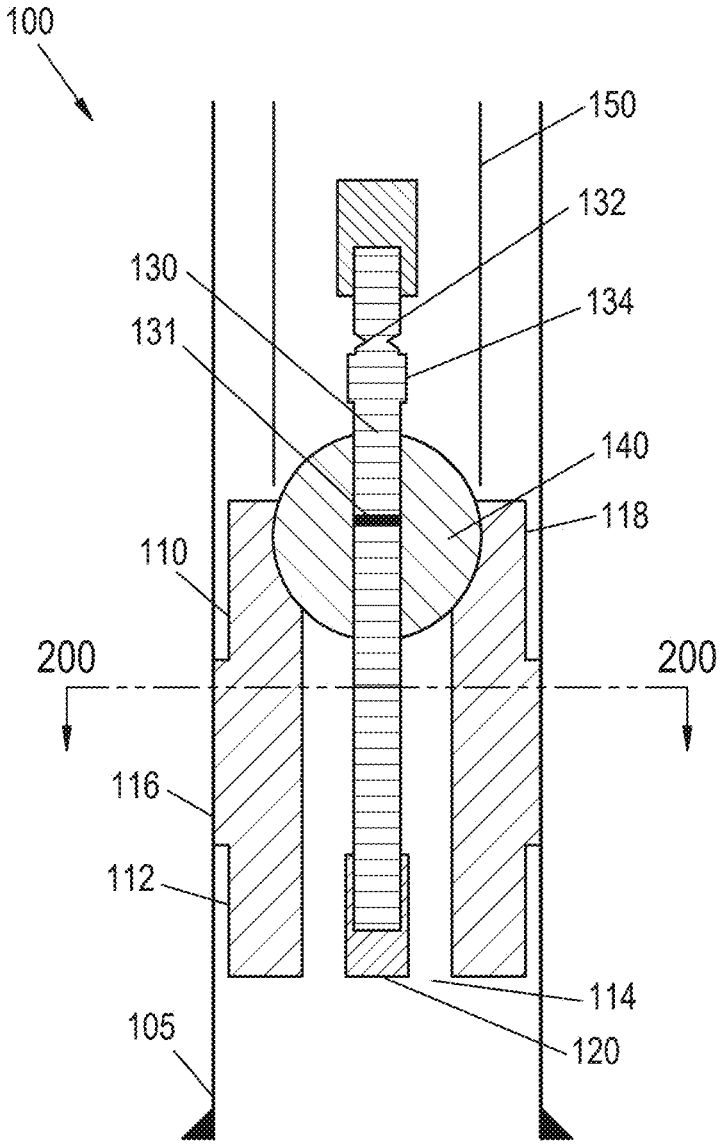
FIG. 1A depicts a downhole tool, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments of the present disclosure. Also, common but well-understood elements that are useful or necessary in a commercially feasible embodiment are often not depicted to facilitate a less obstructed view of these various embodiments of the present disclosure.

DETAILED DESCRIPTION

In the following description, numerous specific details are outlined to provide a thorough understanding of the present invention. It will be apparent, however, to one having ordinary skill in the art that the specific detail need not be employed to practice the present invention. In other instances, well-known materials or methods have not been described in detail to avoid obscuring the present invention.

Figure 1B:
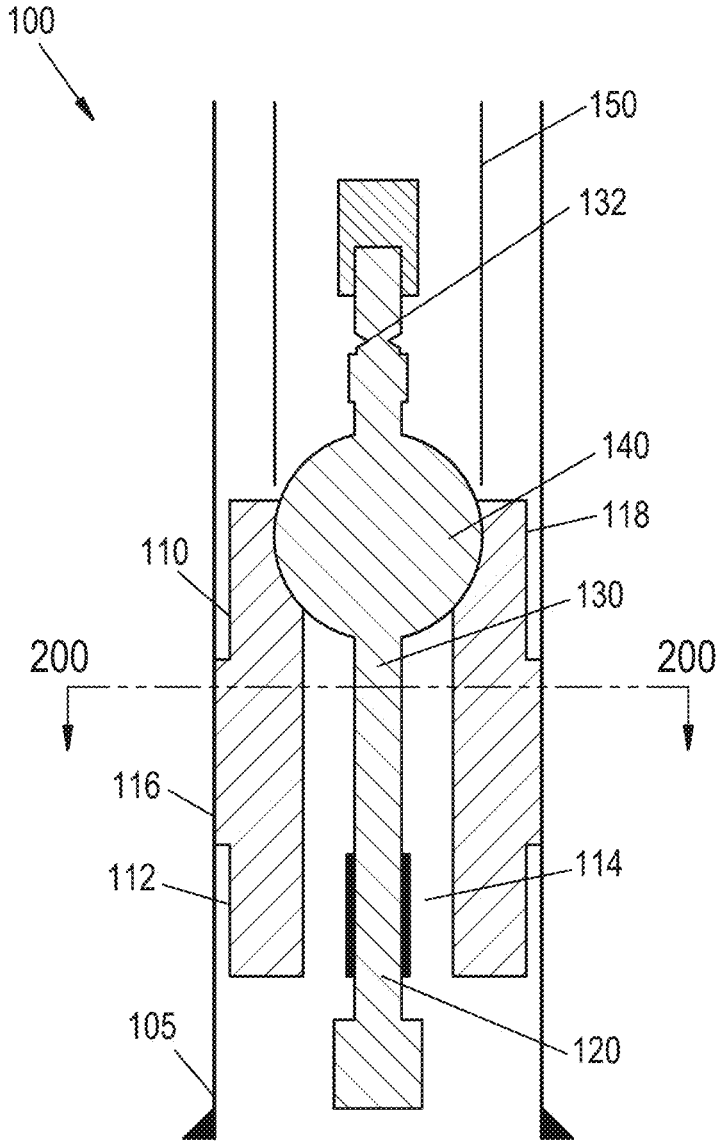
FIG. 1B depicts a downhole tool, according to an embodiment.

FIG. 1 depicts a downhole tool 100, according to an embodiment. The downhole tool 100 may be a frac plug configured to selectively isolate an area below downhole tool 100 from an area above downhole tool 100, wherein the frac plug may be run in a hole with perforating guns, isolate the wellbore, perform a fracturing operation, and reestablish communication within the wellbore in a single run without positioning additional tools downhole. In other embodiments, down hole tool 100 may be run separately. Downhole tool 100 may include a body 110, stem holder 120, stem 130, and object 140. In embodiments, the downhole tool may utilize a setting sleeve 150. Body 110 may be formed of a single piece or multiple parts, for example, a cone-shaped mandrel, a packing element, slips, and a bottom guide, allowing setting sleeve 150 to create a relative movement to break and engage the slips against the casing. In embodiments, body 110 may be made of one piece coupled with a setting ring above the slips.

Body 110 may be a mandrel that is configured to be run in the hole on a wireline, pumped downhole, etc. along with the other elements of the downhole tool in a single run. Body 110 may have an outer diameter 112 is smaller in size than that of casing 105. This may allow fluid to flow in an annulus between outer diameter 112 and casing 105 when body 110 is being pumped downhole. In other embodiments, the body 110 may be composed of a pump down a ring that makes the outer diameter 112 to be equal to that of casing 105. This may prevent fluid from flowing in the annulus when body 110 is being pumped downhole.

Body 110 may also include inner passageways 114 that extend through body 110. In embodiments, passageways 114 may extend from a lower surface of body 110 to an upper surface of body 110. Passageways 114 may allow for fluid to be pumped through body 110 if object 140 does not seal passageways 114. Expandable elements 116 may be positioned on outer diameter 112 of body 110. Body 110 may include seat 118 which is configured to selectively form a seal with object 140. Seat 118 may be configured to receive object 140 when forces are applied downhole against object 140, which may allow a seal to be formed within body 110.

Expandable elements 116 may be slips, packers, etc., or any other element that can extend across the annulus between outer diameter 112 and casing 105 to form a seal. In embodiments, expandable elements 116 may be configured to radially expand responsive to a force being applied against body 110, wherein the force may be created by flowing fluid, setting sleeve 150, etc. Responsive to setting the expandable elements 116, the annulus may be sealed. In embodiments, the expandable elements 116 may be dissolvable elements that are configured to dissolve based on interaction with fluids and/or time and/or temperature.

Stem holder 120 may be a device that is configured to selectively secure stem 130 in place. Stem holder 120 may include channel, groove, slots, etc. that extends within a body of stem holder 120. Stem holder 120 may include a shearing device that is configured to selectively secure stem holder 120 with stem 130. The shearing device may be configured to shear based on the first pressure being applied to the shearing device. After the shearing device is sheared, stem 130 may be removed from stem holder 120. This may allow stem 130 and object 140 to no longer form a seal within body 110. In other embodiments, stem holder 120 and stem 130 may be made of one piece, in such cases, a shearing device may be a weak point machined or engineered between the two.

Stem 130 may be a shaft, rod, etc. that is configured to extend through portions of body 110. Stem 130 may be configured to be inserted through object 140, such that object 140 may slide along stem 130. Stem 130 may include an internal seal 131, which is configured to limit communication between below and above object 140 when it is seated on the body 110 or ball seat 118. In embodiments, internal seal 131 may be fixed in place along stem 130. In embodiments, stem 130 may be configured to extend along a central axis of body 110. In other embodiments, stem 130 and object 140 may be one piece, and stem 130 may be free floating inside stem holder 120.

The first end of stem 130 may initially be coupled to stem holder 120 below the upper surface of body 110. A second end of stem 130 may be positioned within or above an upper surface of body 110 and may be coupled to setting sleeve 150. Stem 130 may include a weak point 132 and a stopper 134. Weak point 132 may be positioned between stopper 134 and the second end of stem 130, and weak point 132 may be configured to break responsive to a force being applied against stem 130. For example, weak point 132 may shear after the force is applied to the setting sleeve 150. In embodiments, the force necessary to shear weak point 132 may be less than or equal to the force necessary to shear the first end of stem 130 from stem holder 120 but higher than the force required to engage the downhole frac plug to the casing, i.e.: the force required to break the slips and energize the packing element. After weak point 132 is sheared, the portions of stem 130 above stopper 134 may be removed from the well.

Stopper 134 may be positioned between weak point 132 and object 140, and may be configured to restrict the movement of object 140 in the first direction. Stopper 134 may have a larger diameter than portions of stem 130 below stopper 134. In embodiments, when object 140 moves in a first direction to be positioned adjacent to stopper 134, object 140 may no longer move in the first direction. Further, in other embodiments, stopper 134 may be a sliding nut, pin, or any other object that increases the diameter of the stem 130. As such, stopper 134 may not be an independent component from stem 130.

Object 140 may be configured to form a seal across the passageways 114 through body 110 in a first mode. Object 140 may have an internal channel that is configured to slide along stem 130. In embodiments, when stem 130 is coupled to stem holder 120, object 140 may move in a first direction to be positioned adjacent to stopper 134 and move in a second direction to be positioned adjacent to seat 118. Accordingly, object 140 may freely slide in the first and second directions based on the forces applied to the upper and lower surfaces of object 140. In the first mode, object 140 may be positioned on seat 118 and seal passageways 114 through body 110. In a second mode, object 140 may slide along the stem 130 to no longer seal passageways 114. In embodiments, object 140 operates as a check valve and may move from the first mode to the second mode based on flow back through the body 110. Furthermore, object 140 may be a dissolvable object that is configured to dissolve, break, or disintegrate over time or based on forces being applied to the object. After object 140 dissolves, it may not be able to form a seal across the inner diameter of body 110. In embodiments, object 140 may be run in the hole along with body 110 along stem 130. In further embodiments, object 140 may be run in a hole in a position across body 110 to form a seal across body 110, which may limit fluid flowing through the passageway through body 110 when run in a hole.

Setting sleeve 150 may be configured to be run in the hole along with body 110, wherein setting sleeve 150 may be a running tool. Setting sleeve 150 may be configured to apply pressure/forces towards body 110 based on the relative movement of setting sleeve 150 and body 110. This relative movement may break portions of expandable elements 116, and allow expandable elements 116 to radially expand. Furthermore, setting sleeve 150 may be configured to apply pressure/force away from body 110 to break stem 130 at weak point 132. After stem 130 is broken, setting sleeve 150 and portions of stem 130 above weak point 132 may be removed from the well together, while downhole tool 100 remains downhole. In embodiments, the relative movement of setting sleeve 150 to body 110 may be in an uphole direction or downhole direction.

Figure 2:
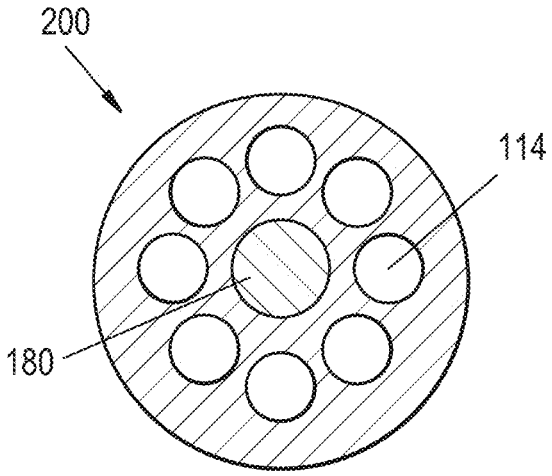
FIG. 2 depicts a cross-sectional view of a downhole tool, according to an embodiment.
Figure 3:
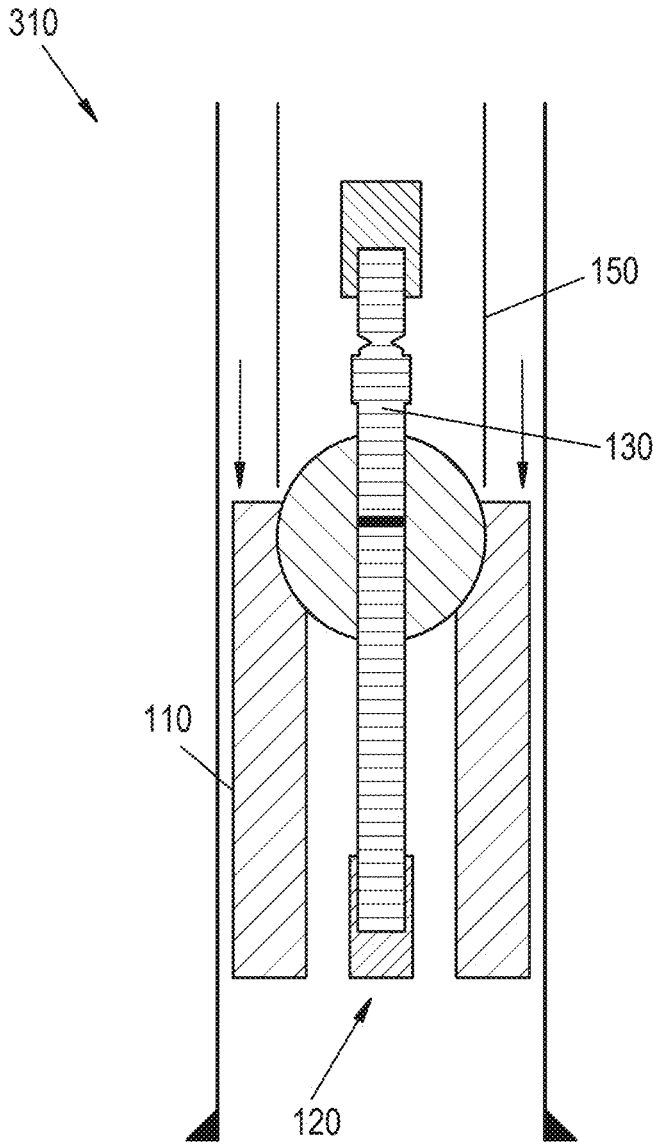
FIGS. 3-7 depicts a method for utilizing a dissolvable Frac Plug, according to an embodiment.
Figure 4:
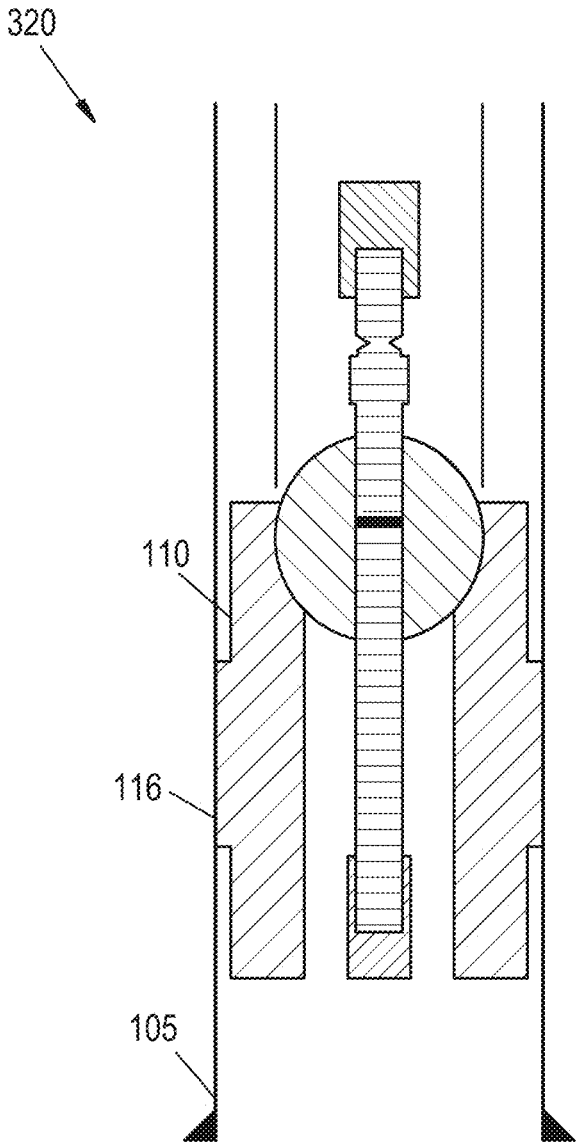
Figure 5:
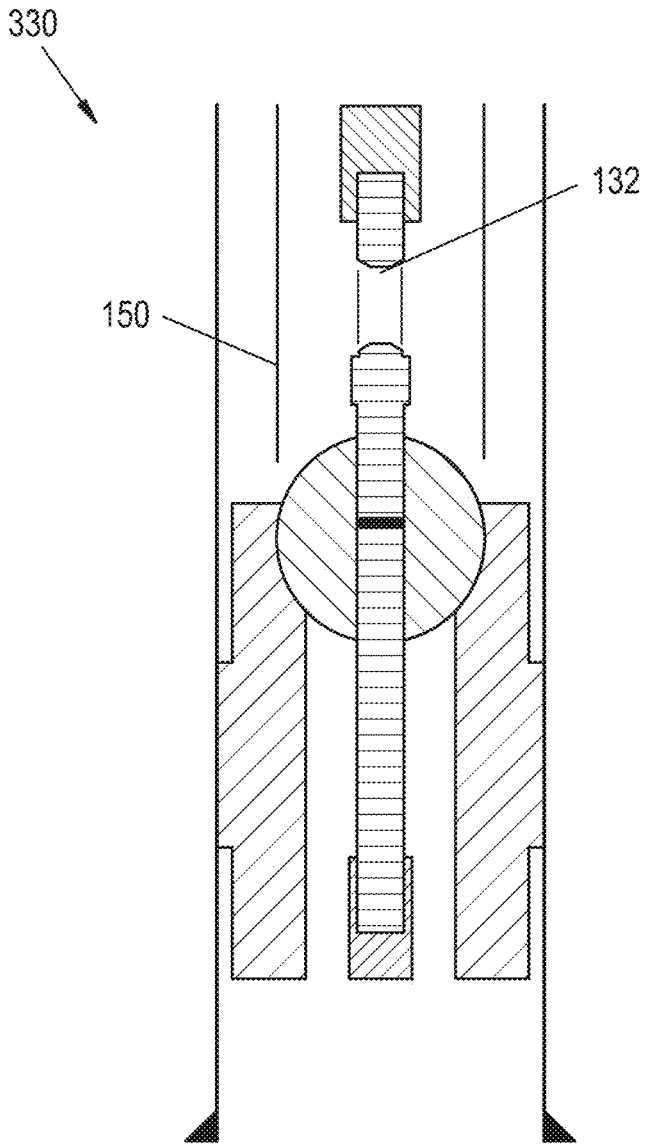
Figure 6:
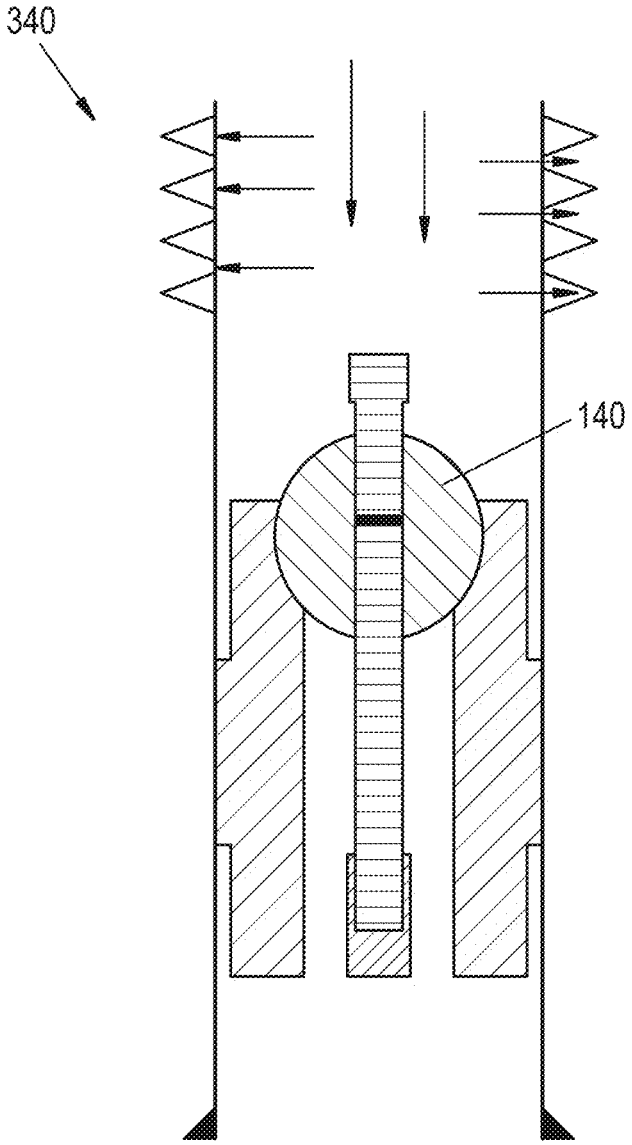
Figure 7:
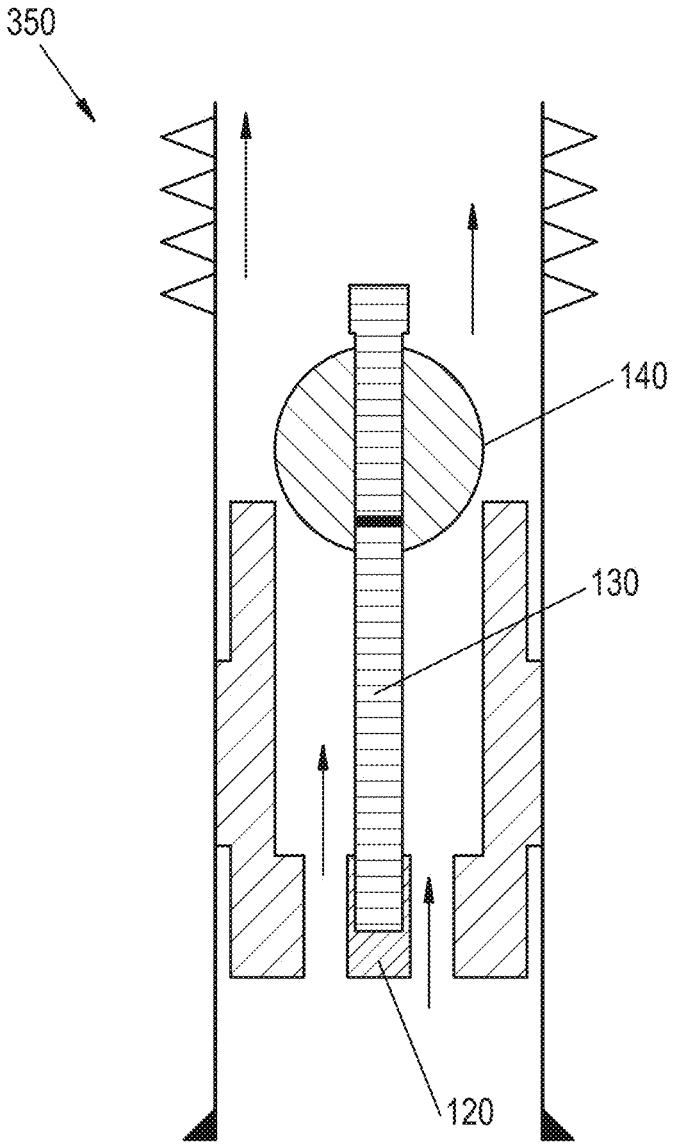

A cross-sectional view 150 of body 110 and stem 130 is depicted in FIG. 2. Elements depicted in FIG. 2 may be described above, and for the sake of brevity, an additional description of these elements may be omitted. As depicted in FIG. 2, body 110 may have a plurality of passageways 114 that allow communication through body 110. However, in other embodiments, passageways 114 may be a singular annular passageway. Stem 130 may be configured to be inserted through, and block, a passageway 114.

FIGS. 3-7 depicts a method for utilizing a dissolvable Frac Plug, according to an embodiment. The operations of the method depicted in the FIGURES are intended to be illustrative. In some embodiments, the method may be accomplished with one or more additional operations not described, and/or without one or more of the operations discussed. Additionally, the order in which the operations of the method are illustrated in the FIGURES and described below is not intended to be limiting.

At operation 310, a frac plug may be run in a hole. The frac plug may be run in a hole via any conveying method or on a wireline where it can be pumped downhole. Further, when the frac plug is traveling downhole, an object may be positioned on a seat within the frac plug to limit communication through an inner diameter of the frac plug.

At operation 320, a setting tool above the setting sleeve may be activated causing the setting sleeve to move and expandable elements, such as slips, may be set, which may cause the slips to radially extend across the annulus. This coupled with the expansion of the packing element or O-rings may form a seal across the annulus. In embodiments, the slips may be set by a setting sleeve pushing against the body, causing the slips to break, and radially expand.

At operation 330, a weak point on a stem positioned above an object may be broken based on the force applied by the setting sleeve. After the weak point is broken, an upper portion of the stem above the weak point may be disconnected from a lower portion of the stem. The pulling force applied by the setting sleeve may allow the upper portion of the stem and the setting sleeve to be retrieved together. In other embodiments, the upper portion of the stem may be eliminated and the weak point is a thread that shears at a pre-determined force.

At operation 340, while the object is positioned on the seat and the slips are set, a fracturing or stimulation procedure may occur above the object. More specifically, the object may isolate an area below the frac plug from an area above the frac plug, allowing pressure to build above the frac plug for the fracturing procedure. In other embodiments, stem 130 may shear downward (first direction) from stem holder 120, this may allow the object 140 and the stem to flow upward in operation 350

At operation 350, fluid may flow from backward below the object to move the object along the stem away from the seat, while the stem is still coupling to the stem holder. When the object moves away from the seat, the area below the frac plug and the area above the frac plug may be in communication with each other through a passageway through the body. As such, the object may operate as a check valve along the stem. In further embodiments, the stem may be sheared from the stem holder, which may allow the object and stem to be removed from the body.

Figure 8:
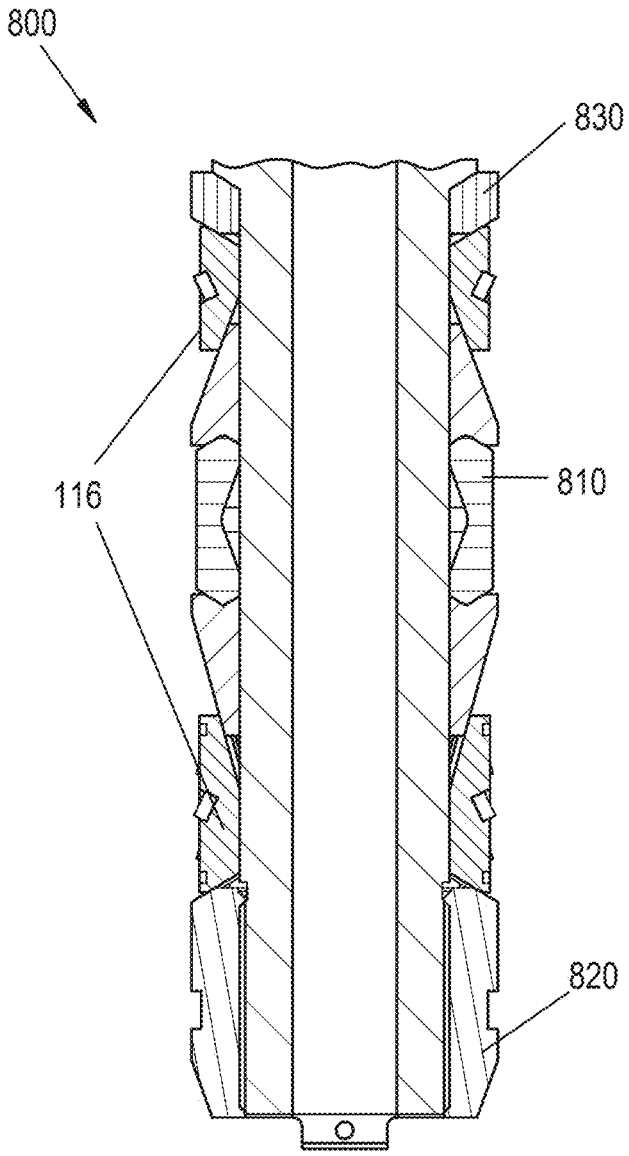
FIG. 8 depicts a downhole tool, according to an embodiment.

FIG. 8 depicts a body 110, according to an embodiment. Elements depicted in FIG. 8 may be described above, and for the sake of brevity, a further description of these elements is omitted.

Further body 810 may include slips 116 that breaks or flexes to increase the final diameter of the downhole tool 100. After slips 116 breaks and the diameter of downhole tool 100 increases, slips may engage and anchor into the casing 105. This may allow isolation between the bottom and top of the downhole tool 800. In other embodiments, downhole tool 100 expandable elements 116 may include packers 810, cones, etc. In other embodiments, expandable element 116 may be only a single set of lower slips located between the packing element 810 and the bottom guide 820.

Additionally, the downhole tool 800 may include a bottom guide 820 that is configured to assist in setting the expandable elements 116. In embodiments, stem holder 112 may be coupled or become an integral part of the bottom guide 820, which may enable the stem holder 112 to be positioned below and/or into the hollow passageway of body 110.

Downhole tool 830 may also include a load ring 830 that is configured to receive forces applied by setting sleeve 150. When load ring 830 receives the forces from setting sleeve 150, load ring 830 may move to shorten the distance between load ring and bottom guide 820, which may cause expandable elements 116 to expand.

Figure 9:
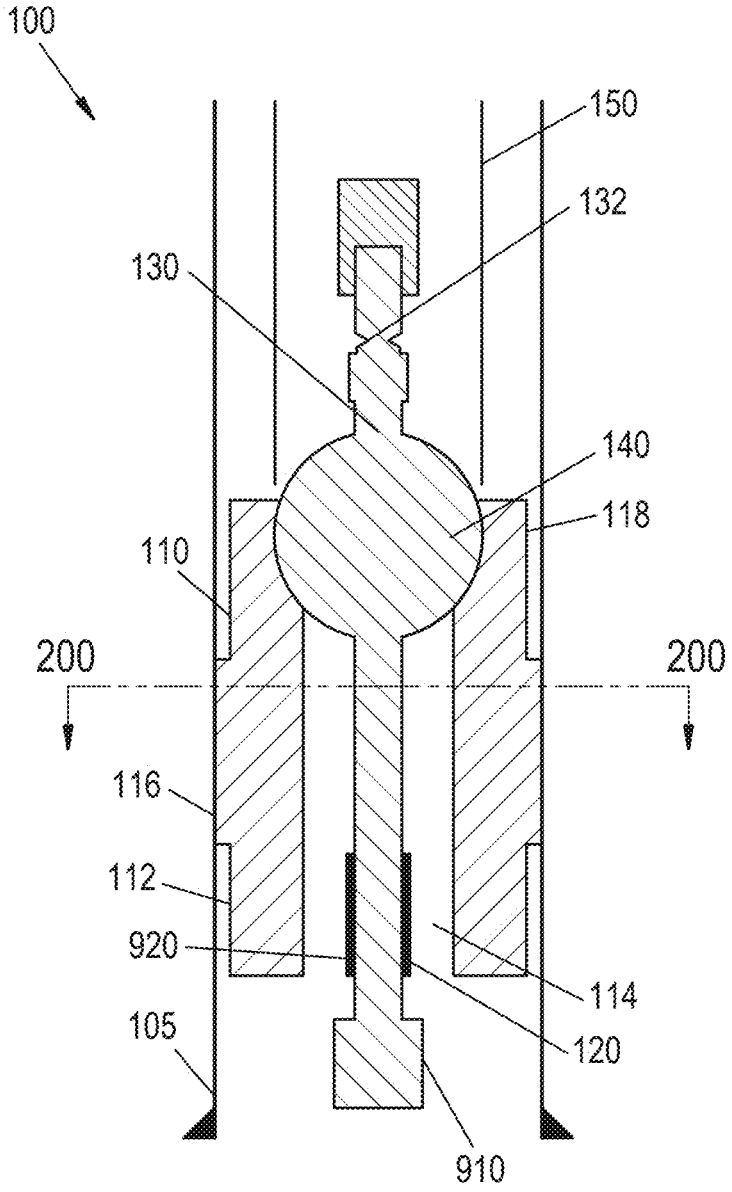
FIG. 9 depicts a downhole tool, according to an embodiment.

FIG. 9 depicts a downhole tool 900, according to an embodiment. Elements depicted in FIG. 9 may be described above, and for the sake of brevity, an additional description of these elements may be omitted.

As depicted in FIG. 9, stem 130 and object 140 may be a single piece, whereas object 140 may be fixed to stem 130. Further, stem holder 120 may have a hollow passageway 920. Hollow passageway 920 may extend through a body of stem holder 120.

A distal end 910 of stem 130 may include a stopper. The stopper may have a diameter that is greater in size than stem holder 120, while the body of stem 130 may have a diameter that is slightly smaller than that of the hollow passageway 920 through stem holder 120. In embodiments, stem 130 may be configured to freely move in a first direction until object 140 is positioned adjacent to seat 118, and stem 130 may be configured to freely move in a second direction until an upper surface of the stopper is positioned adjacent to stem holder 120.

Figure 10:
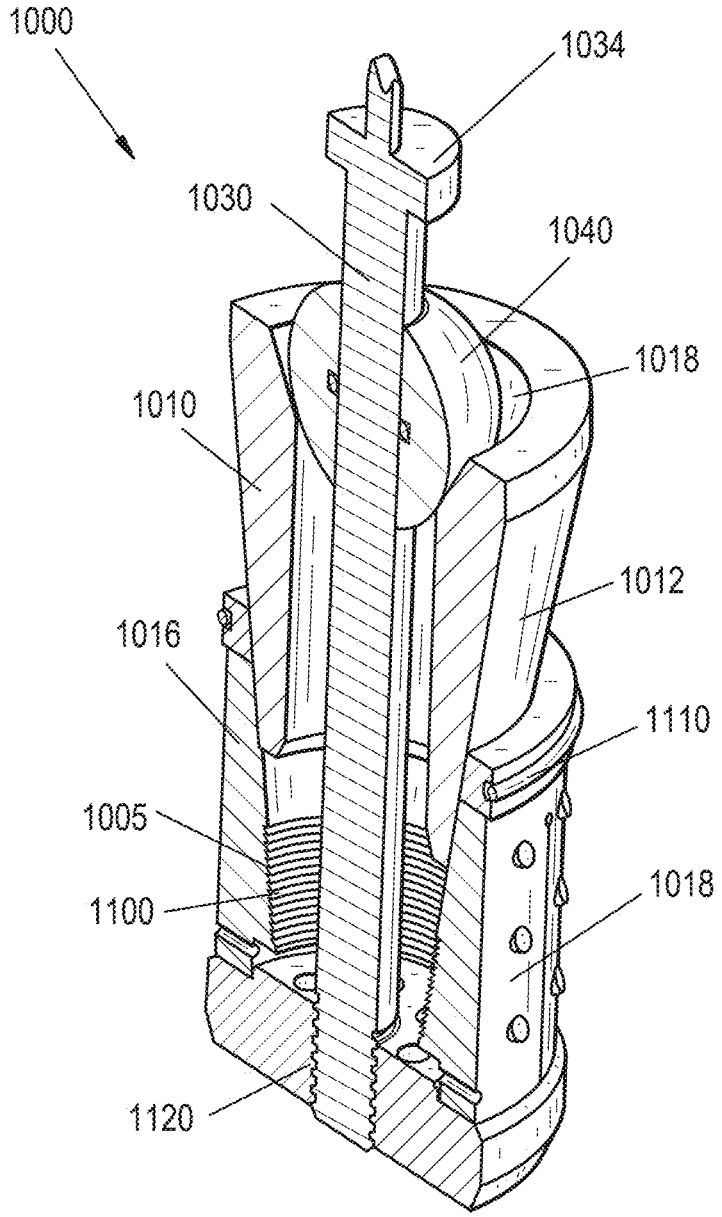
FIG. 10 depicts a downhole tool, according to an embodiment.
Figure 11:
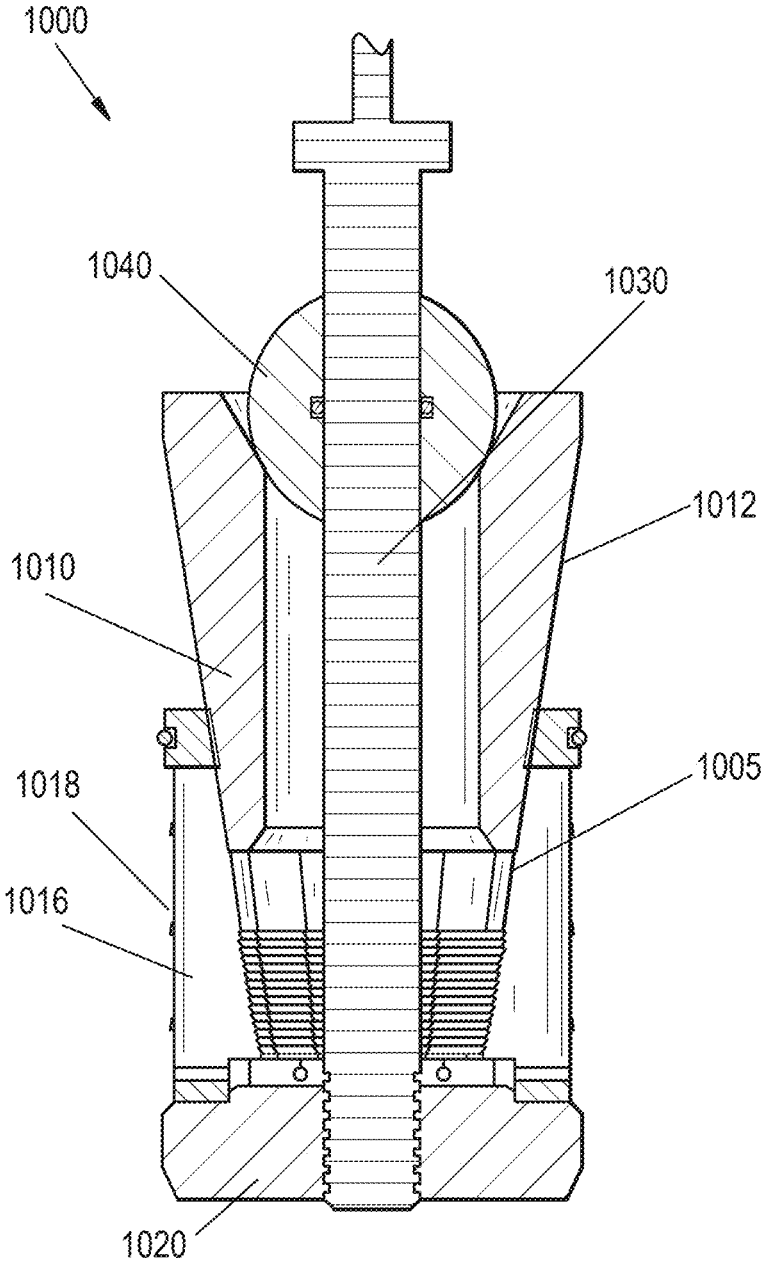
FIG. 11 depicts a downhole tool, according to an embodiment.

FIGS. 10 and 11 depict a downhole tool 1000, according to an embodiment. Elements depicted in FIGS. 10 and 11 may be described above, and for the sake of brevity, a further description of these elements may be omitted. Downhole tool 1000 may include a body 1010, expandable elements 1016, stem holder 1020, stem 1030, and object 1040.

Body 1010 may include tapered external sidewalls 1012 that decrease the diameter across body 1010 from a proximal end to a distal end of body 1010. Stem 130 may have an upper portion that extends above the upper surface of body 1010 and a lower portion that extends below the lower surface of body 1010. Expandable elements 1016 may have tapered internal sidewalls 1005 that decrease an internal diameter across expandable elements from a proximal end to a distal end of expandable elements 1016. Due to the tapering of external sidewalls 1012 and internal sidewalls 1005, body 1010 may drive downward to radially expand the external sidewalls 1018 of expandable elements 1016.

When run in the hole the outermost outer diameter of body 1010 will be greater than that of expandable elements 1016. However, once expanded outer diameter 1018 may have a larger diameter than that of outer diameter 1012.

Additionally, internal sidewalls 1005 may include a series of teeth 1100. Teeth 110 may work as a ratchet that allows for the movement of body 1010 in a single direction while limiting the movement of body 1010 in a reverse direction. This may assist in allowing body 1010 to be driven downward against expandable elements 1016 to expand the corresponding slips.

Downhole tool 1000 may also include element 1110, which may be an O-ring or in other embodiments a packing element. The O-ring may be positioned over a breakable piece that allows the O-ring to expand to touch the casing and form a seal. In other occasions, element 1110 may be a packing element, which may be configured to radially expand across the annulus based on compressive forces applied to element 1110. Reference throughout this specification to "one embodiment", "an embodiment", "one example" or "an example" means that a particular feature, structure, or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures, or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

Although the present technology has been described in detail for illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

What is claimed is:

1. A frac plug comprising:

a body with a hollow passageway;

a stem configured to extend into the hollow passageway;

an object positioned on the stem, the object is configured to seal the hollow passageway when the object is positioned on the body, wherein the object is slidably mounted on the stem, and the object moves in a first direction and unseals the passageway when fluid flows in the first direction through the passageway;

a weak point that is configured to break and disconnect the stem from a running tool, wherein the running tool is retrieved from a well before a fracturing procedure.

2. The frac plug of claim 1, wherein the stem includes:

a stopper configured to limit the movement of the object along the stem in a first direction, the weak point being positioned between the stopper and the running tool.

3. The frac plug of claim 2, wherein the stopper and stem are a unified and singular component.

4. The frac plug of claim 2, wherein the stopper is an independent component from the stem.

5. The frac plug of claim 1, wherein the frac plug is a single slips configuration and requires the running tool to be connected to a bottom of the frac plug through the stem.

6. The frac plug of claim 1, further comprising:

expandable elements that are made of dissolvable elements, and the body and the object are made of dissolvable material.

7. The frac plug of claim 1, wherein the stem and the object are a single unified piece, wherein the stem is free floating.

8. The frac plug of claim 1, further comprising:

a stopper positioned on a distal end of the stem, the stopper being configured to restrict movement of the stem.

9. The frac plug of claim 1, wherein a stem holder configured to selectively secure the stem within the body.

10. The frac plug of claim 9, wherein the stem is connected to the stem holder, and the stem holder is part of a bottom guide.

11. A frac plug comprising:

a body with a hollow passageway;

a stem configured to extend into the hollow passageway;

an object positioned on the stem, the object is configured to seal the hollow passageway when the object is positioned on the body;

a weak point that is configured to break and disconnect the stem from a running tool, wherein the running tool is retrieved from a well before a fracturing procedure; and a stem holder with a channel, the channel extending through the stem holder, wherein the stem is configured to slide along the channel.

12. The frac plug of claim 11, wherein the running tool and an upper portion of the stem are retrieved together.

13. A method associated with a frac plug comprising:

positioning an object on a stem;

extending the stem into a hollow passageway of a body;

sealing the hollow passageway when the object is positioned on the body;

breaking a weak point on the stem to disconnect the stem from a running tool, wherein the running tool is retrieved from a well before a fracturing procedure;

breaking the weak point to disconnect an upper portion of the stem from a lower portion of the stem; and limiting movement of the object along the stem via a stopper, the weak point being positioned between the stopper and the upper portion of the stem.

14. The method of claim 13, wherein the object is secured in place along the stem, and the object and the stem are a unified part.

15. The method of claim 14, further comprising:

sliding the stem through a channel, wherein the channel extends through a stem holder.

16. The method of claim 15, further comprising:

positioning a stopper on a distal end of the stem, wherein the object restricts movement of the stem in a first direction, and the stopper restricts movement of the stem in a second direction.

* * * * *